US006030464A

United States Patent [19]

Azevedo

[11] Patent Number: 6,030,464

[45] Date of Patent: Feb. 29, 2000

[54] METHOD FOR DIAGNOSING, CLEANING AND PRESERVING CARPETING AND OTHER FABRICS

[76] Inventor: Steven Azevedo, 235 Frank West Cir., Stockton, Calif. 95206

[21] Appl. No.: 09/014,736

[22] Filed: Jan. 28, 1998

[51] Int. Cl.[7] ..... B08B 1/00; B08B 3/10; B08B 5/04; B08B 7/04; A47L 11/20

[52] U.S. Cl. ..... 134/6; 134/18; 134/21; 15/339

[58] Field of Search ..... 134/6, 18, 21; 15/339

[56] References Cited

U.S. PATENT DOCUMENTS

| | | | |
|---|---|---|---|
| 3,728,075 | 4/1973 | Cannan | 8/147 |
| 3,871,051 | 3/1975 | Collier | 15/321 |
| 4,063,961 | 12/1977 | Howard et al. | 134/4 |
| 4,109,340 | 8/1978 | Bates | 15/321 |
| 4,244,079 | 1/1981 | Bane | 15/321 |
| 4,284,127 | 8/1981 | Collier et al. | 15/321 |
| 4,321,095 | 3/1982 | Argo et al. | 134/6 |
| 4,353,145 | 10/1982 | Woodford | 15/21 |
| 4,595,420 | 6/1986 | Williams III, et al. | 134/6 |
| 5,105,502 | 4/1992 | Takashima | 15/319 |
| 5,147,467 | 9/1992 | Virtue | 134/18 |
| 5,180,439 | 1/1993 | Allison | 134/21 |
| 5,323,483 | 6/1994 | Baeg | 388/811 |
| 5,815,884 | 10/1998 | Imamura et al. | 15/339 |

*Primary Examiner*—Zeinab El-Arini
*Attorney, Agent, or Firm*—Bernhard Kreten

[57] ABSTRACT

A method for assaying fibrous material, such as carpet (or other fabric) condition, and treating the fibrous material such as carpet by physically separating contaminating particulate matter therefrom, thereafter releasing entrained matter, and absorbing the released formerly entrained matter.

19 Claims, 10 Drawing Sheets

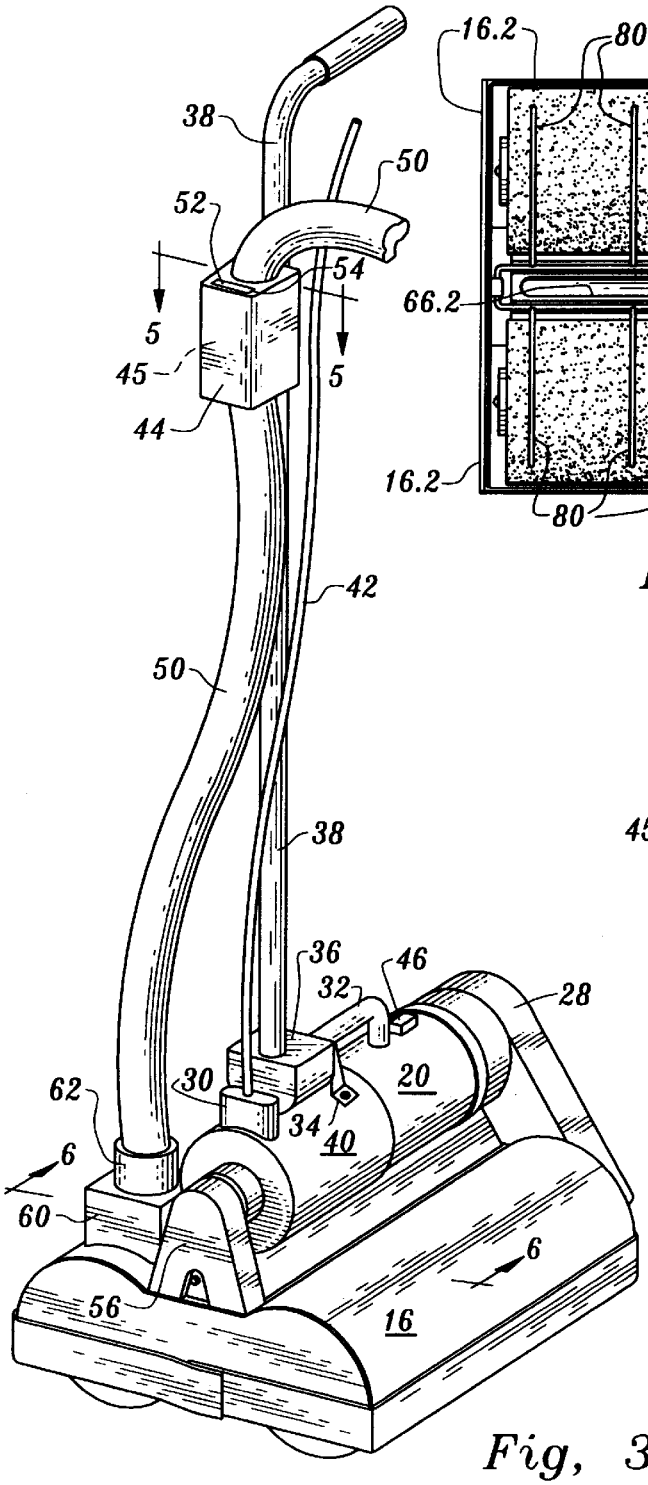
Fig, 3
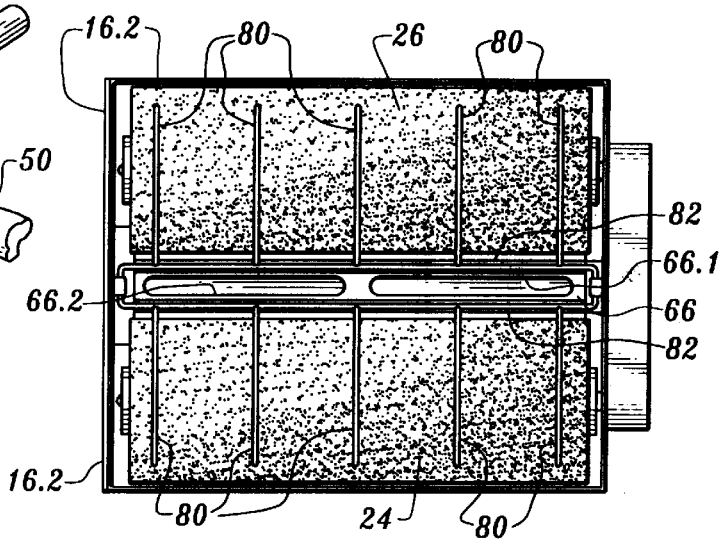
Fig. 4
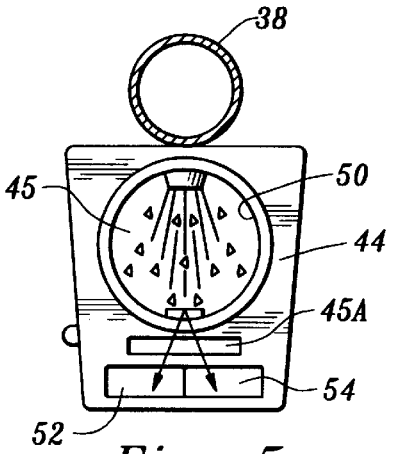
Fig. 5

METHOD FOR DIAGNOSING, CLEANING AND PRESERVING CARPETING AND OTHER FABRICS

FIELD OF THE INVENTION

The present invention relates to the diagnosing, cleaning and preservation of carpets and other fabrics, and more particularly to novel methods of such cleaning and preservation, employing novel combinations of cleaning equipment and novel fabric treatment materials.

BACKGROUND OF THE INVENTION

Methods, apparatus and systems for cleaning carpet and other fabrics are well known in the prior art. It is believed, however, that the methods, apparatus and system disclosed and claimed herein, and particularly the fabric diagnostic, cleaning and preservation aspects of the present invention, are not anticipated by any of the prior art, when taken singly or properly combined.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| U.S. PAT. NO. | ISSUE DATE | INVENTOR |
|---|---|---|
| 3,728,075 | April 17, 1973 | Cannan |
| 3,871,051 | March 18, 1975 | Collier |
| 4,063,961 | December 20, 1977 | Howard, et al. |
| 4,109,340 | August 29, 1978 | Bates |
| 4,244,079 | January 13, 1981 | Bane |
| 4,284,127 | August 18, 1981 | Collier, et al. |
| 4,321,095 | March 23, 1982 | Argo, et al. |
| 4,353,145 | October 12, 1982 | Woodford |
| 4,595,420 | June 17, 1986 | Williams, III, et al. |
| 5,147,467 | September 15, 1992 | Virtue |

Argo, et al.'s patent teaches the use of barbed plastic bristles or fingers overlying carpet with terrycloth interposed therebetween. This arrangement causes the fingers to penetrate into the carpet tending to permanently distort the carpet.

Howard, et al. first agitates the carpet and subsequently vacuums debris. Applicant, by contrast, concurrently brushes the pile upwardly and vacuums while sensing particle density. This makes more efficient and objective the initial carpet cleaning and grooming. Further, Howard, et al. requires the cleaning agent to dry and become crystalline prior to final vacuuming. This strategy results in a slow process to wait for drying and encourages residual buildup of cleaning agents which assures the cleaning agent remaining will be a dirt attractant. The effect is to have the carpet become resoiled very quickly.

Cannan's cleaning device tends to swirl the dirt. Once the pad has become saturated, the dirt is merely circulated.

The remaining citations diverge more starkly from the instant invention.

OBJECTS OF THE INVENTION

It is an object of the present invention to provide novel methods, apparatus and system for cleaning and preserving carpets and other fabrics which have greater cleaning efficiency than carpet and light fabric methods, apparatus and systems of the prior art.

It is a further object of the present invention to provide carpeting and light fabric cleaning and preserving methods, apparatus and system which minimize the wetting of the carpeting or other fabric (light fabric) being cleaned during the execution of the methods of the invention.

It is a yet further object of the present invention to provide carpeting and light fabric cleaning and preserving methods, apparatus and systems which minimize the amount of cleaning solution which reaches the backing and the lower parts of the filaments of the shafts of the pile when carpeting is being cleaned thereby.

It is another object of the present invention to provide carpeting and light fabric cleaning and preserving methods, apparatus and systems during the utilization of which the maximum possible amount of particulate matter is removed from the carpet or light fabric when the carpet or light fabric is in its dry state.

Yet another object of the present invention is to provide carpeting and light fabric cleaning and preserving methods, apparatus and systems during the utilization of which, to clean carpeting, a minimum amount of particulate material is transported downwardly to discourage collecting of dirt on the lower parts of the shafts of the pile and on the backing.

A further object of the present invention is to provide a drybrush vacuum machine which serves to extract an optimum amount of particulate material from a unit area of carpeting when that carpeting is in its dry condition.

A yet further object of the present invention is to provide carpet cleaning method and materials which, when used in accordance with the invention, leave a minimum amount of residue within the carpet structure.

A further object of the present invention is to provide carpet treating materials which achieve at least some of the above-objects and further provide lubricating properties which tend to prevent burning of the carpet or fabric being cleaned.

An additional object of the present invention is to provide novel systems for use in cleaning and preserving carpets and other fabrics, the components of which systems include the methods, apparatus and treatment of materials thereof, are so coordinated, in accordance with the invention as to preserve the carpeting or other fabric which is regularly treated thereby, to minimize the treatment material residue left in the structure of the treated carpet or fabric, to minimize the amount of moisture left in the carpet or fabric after treatment, to lubricate the carpet or fabric being treated to limit or avoid burning and generally to optimize the methods, materials and apparatus applied to the carpet or fabric so as to best clean and preserve the carpet or fabric.

Other objects of the present invention will in part be obvious and will in part appear hereinafter.

SUMMARY OF THE INVENTION

The present invention, accordingly, comprises the several steps and the relation of one or more of such steps with respect to each of the others, and the apparatus and systems embodying features of construction, combinations of elements, and arrangements of parts which are adapted to effect such steps, all as exemplified in the following disclosure, and the scope of the present invention will be indicated in the claims appended hereto.

The key to this invention involves precise attention to the mechanics of carpet and fabric contamination so that its removal is most efficiently performed. Purified water allows much less cleaning solution to be used. The cleaning solution is preferably neutral in pH and only a modest amount of both water and cleaning solution is used. By topically applying the cleaning solution in small quantities, the water is easily retrieved from the surface by successive toweling with plural towels. Residual water in the carpet is no longer a problem and its attendant problems of bacteria, mold, spore and pathogen growth has been solved. Removal of the cleaning solution removes a dirt attractant. The initial vacuuming process in conjunction with brushing extends down to the backing of the carpet and provides superior cleaning minimizing the amount of contamination that must be removed through the cleaning solution. The particle density sensor assures that maximum contamination will have been removed from the carpet before advancing to another area, thereby making an objective evaluation of carpet condition while vacuuming/brushing. Whereas prior art techniques focus on more powerful equipment, chemicals and more water, this approach is minimalist, more effective and efficient.

In accordance with a principal feature of the present invention a method of the invention has for its first step the dry brushing and vacuuming of the carpeting to be cleaned in order to remove a large percentage of the particulate matter from the structure of the carpet to be cleaned before any steps take place which involve the wetting of the carpet to be cleaned.

In accordance with another principal feature of the present invention said first step may be carried out by means of a dry brushing and vacuuming device ("drybrush machine") of the present invention which comprises a particle density sensor which displays the momentary density of the particles passing through the exhaust port of the drybrush machine to the operator thereof, whereby the operator is notified to arrest the progress of the drybrush machine over the carpet if the area of the carpet confronting the pickup aperture of the drybrush machine has not been sufficiently purged of particulate matter.

In accordance with yet another principal feature of the present invention said drybrush machine comprises a housing containing contrarotating brushes which are driven by motive means incorporated into the drybrush machine.

In accordance with a further principal feature of the present invention said drybrush machine is not provided with wheels or the like, but rather the entire weight of the drybrush machine is borne by said brushes, which themselves bear directly upon the carpet to be cleaned.

In accordance with a further principal feature of the present invention said housing is provided with a rigid skirt having an adjustable lower edge, and said adjustable lower edge can be so adjusted that when said drybrush machine is borne by a carpeted surface said adjustable edge contacts the top of the pile of the carpet to be cleaned or projects slightly into the carpet pile and a vacuum pulls away debris in conjunction with the brushing.

In accordance with another principal feature of the present invention a quantity of water is heated and purified by means of a portable water purifying device and a predetermined quantity of the purified water is mixed with a cleaning solution.

In accordance with another principal feature of the present invention a quantity of solution is then sprayed onto a selected area of the carpet to be cleaned (sometimes called the "treatment area").

In accordance with a further principal feature of the present invention a clean terrycloth towel is then placed upon a part of said treatment area, and an agitating machine of the present invention (sometimes called a "toweling machine") is deposited upon the exposed surface of said terrycloth towel.

In accordance with a yet further principal feature of the present invention said toweling machine is then energized to wipe said towel across the surface of said treatment area, whereby to extract the remaining particulate matter from the treatment area and also to remove the remaining moisture from said part of the treatment area over which the toweling machine is passed.

In accordance with yet another principal feature of the present invention light fabrics, such as upholstery fabric, can be cleaned by applying the same materials thereto, using hand-held toweling and drybrush machines.

In accordance with a further principal feature of the present invention said toweling machines of the present invention coincidentally resemble in many particulars eccentric plate floor sanding machines, but which has been extensively modified to work on carpet.

For a fuller understanding of the nature and objects of the present invention, reference should be had to the following detailed description, taken in connection with the accompanying drawings.

BRIEF DESCRIPTION OF THE DRAWINGS

FIG. 3 is another perspective view of the drybrush machine of the first preferred embodiment of the present invention shown in FIG. 1.

FIG. 4 is a bottom view of the drybrush machine of the first preferred embodiment of the present invention shown in FIG. 1.

FIG. 5 is a partial cross-sectional view of the drybrush machine of the first preferred embodiment of the present invention shown in FIG. 3, taken on plane 5—5, showing a particle density sensor and display.

DESCRIPTION OF PREFERRED EMBODIMENTS

Figures 1, 2:
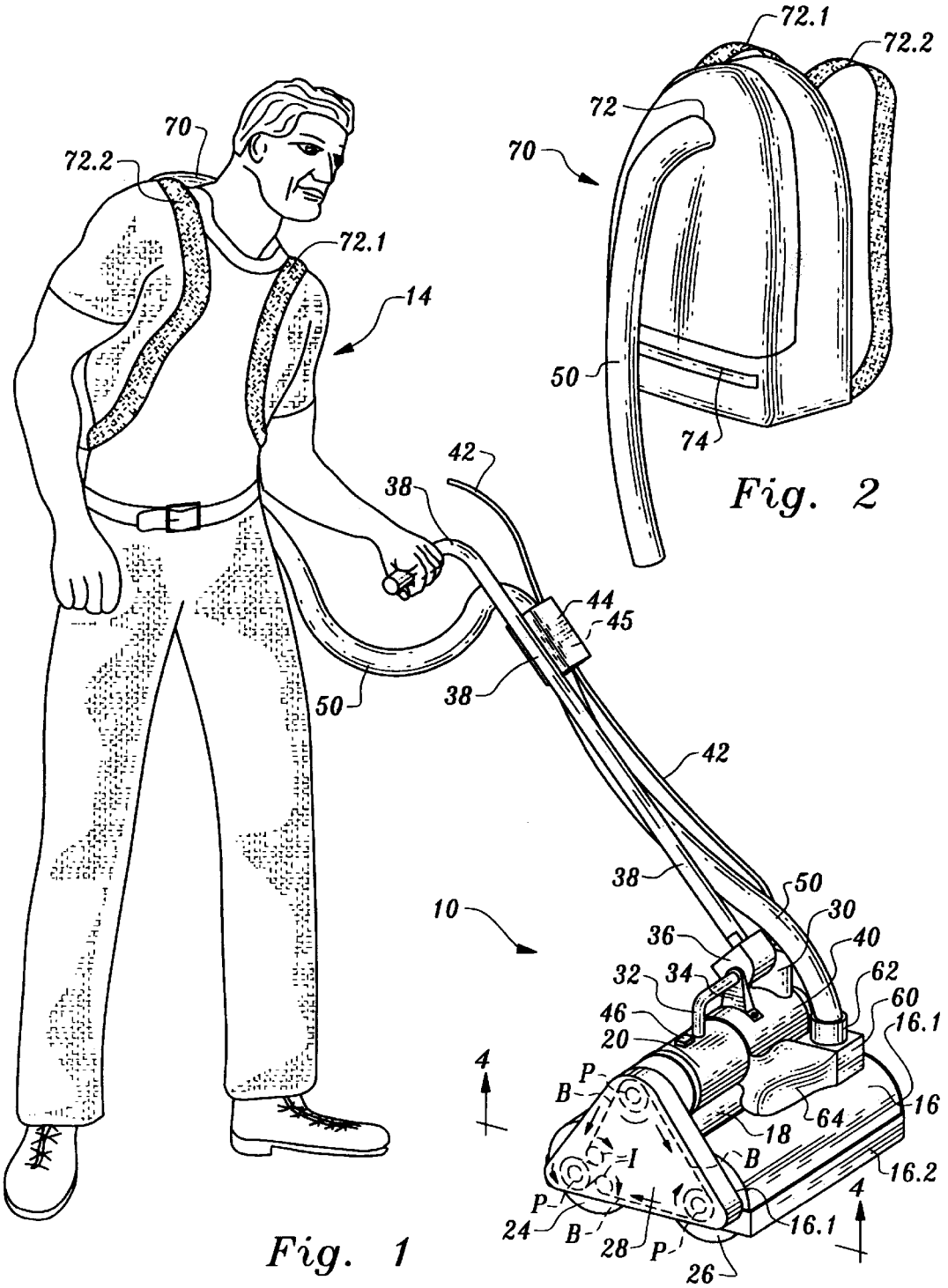
FIG. 1 is a perspective view of the drybrush-vacuum machine of the first preferred embodiment of the present invention, and the operator thereof.
FIG. 2 is a perspective view of a vacuum backpack which is a part of the drybrush machine of the first preferred embodiment of the present invention shown in FIG. 1.

Considering the drawings, wherein like reference numerals denote like parts throughout the various drawing figures, reference numeral 10 is directed to the drybrush machine according to the present invention.

Referring now to FIG. 1, there is shown the drybrush machine 10 of the first preferred embodiment of the present invention as it is propelled across a carpet 12 by an operator 14.

Drybrush machine 10 is comprised of a housing 16 having a spine 18 upon which is mounted a brush drive motor 20.

Housing 16 contains a pair of cylindrical brushes 24, 26 which are mounted on suitable bearings, which bearings are affixed to the respective end walls 16.1 of housing 16.

The shafts of brushes 24 and 26, which pass through an opposite end wall 16.1 of housing 16, and also pass through a pair of said bearings, are provided on those extended ends with suitable pulleys P.

The shaft 41 (FIG. 6) of brush drive motor 20 is also provided with a suitable pulley P (FIG. 1).

Figure 6:
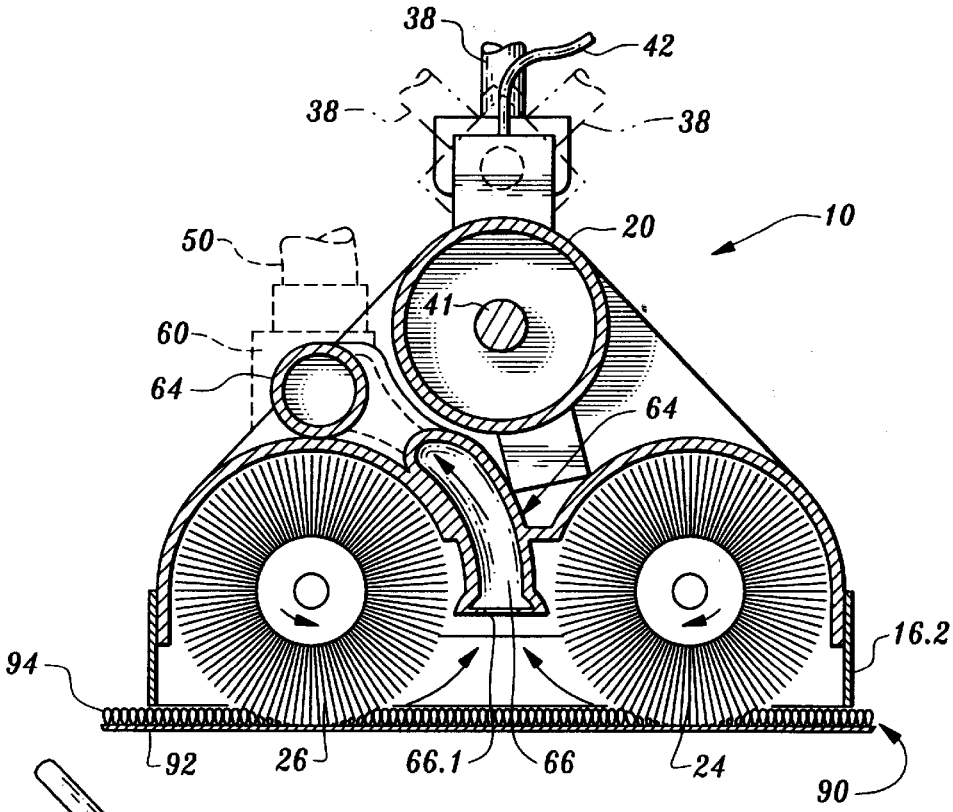
FIG. 6 is a cross-sectional view in elevation of the drybrush machine of the first preferred embodiment of the present invention shown in FIG. 3, taken on plane 6—6.

Said pulleys are coupled together by a belt arrangement B of the kind which can be provided by those having ordinary skill in the art, informed by the present disclosure, without the exercise of invention or undue experimentation, so that whenever the shaft of the brush drive motor turns the brushes turn about their respective axes at the same speed of rotation. Brushes 24 and 26 rotate in opposite directions, so that, as seen in FIG. 6, the bottommost part of each brush 24, 26 moves toward the other brush. Two idlers I operate against one brush pulley P to cause counter rotation.

As seen in FIG. 1, this belt arrangement, including said idlers and pulleys, is covered by a protective cover 28 to prevent the contact of human body parts, etc., with said brush arrangement and said pulleys.

As seen in FIGS. 1 and 3, brush drive motor 20 is provided with a power cord receptacle 30 which also serves as support for one end of pivot rod 32. The other end of pivot rod 32 is firmly supported by support bracket 34 and the inner end of pivot rod 32, which is affixed to drive motor 20.

A pivot block 36 is pivotably mounted on pivot rod 32 (FIGS. 1 and 3).

As also seen in FIGS. 1 and 3, a handle 38 is rigidly affixed to pivot block 36, and thus it will be understood by those having ordinary skill in the art, informed by the present disclosure, that handle 32 is pivotably attached to pivot block 32 so that handle 38 can be rotated about the longitudinal axis of pivot rod 32 while remaining at all times perpendicular to the axis of pivot rod 32.

Referring again to FIG. 3, it will be seen that one end of brush drive motor 20 is affixed to one end of a hollow cylindrical electrical conduit housing 40.

Conduit housing 40 contains the interconnections between brush drive motor 20 and the electrical conductors contained in a power cord 42.

Power cord 42 is of well known type, and serves to convey electrical power from a conventional wall outlet to brush drive motor 20 via said interconnections contained in conduit housing 40.

As seen in FIGS. 1, 3 and 5, a particle density sensor or housing 44 is mounted on handle 38.

It is to be understood that a switch 46 (FIGS. 1 and 3) controls the application of electrical power to brush drive motor 20, and that depression of switch 46 brings about the energization of brush drive motor 20, whereas a second depression of switch 46 deenergizes brush drive motor 20.

As may be seen by comparison of FIGS. 1, 3 and 5, an exhaust hose 50 passes through particle density sensor or housing 44.

Contained within particle density sensor or housing 44 is a particle density sensor detector 45 of well known type, which is available from Homelife Mfg., Post Office Box 189, Webster City, Iowa 50595. The sensor detector 45 operates as a photoelectric light and sensor which signals to the operator 14 when the particle density is low enough to proceed to vacuum and brush more of the carpet. In essence, optical path clarity correlates with particle density.

The pickup portion (FIG. 5) of the particle density sensor detector 45 is contained in a rigid insert in exhaust hose 50 which is itself contained in housing 44, and is connected to the remainder of the particle density sensor detector 45 by means of a sealed hole in the wall of said insert.

The particle density sensor detector circuit 45A serves to alternatively energize, and thus illuminate, one of the two lights 52, 54 which are mounted in the top of particle density sensor or housing 44 (FIG. 5) and visable to the operator 14.

Light 52 is colored green, and is illuminated whenever the particle density insert 50 is less than a predetermined value. Whenever the particle density in said portion is greater than said predetermined value, light 52 is extinguished and light 54, which is colored red, is illuminated.

Thus, by observing lights 52 and 54 (FIG. 5), operator 14 can determine when drybrush machine 10 should be moved over carpet 12, and when drybrush machine 10 should be allowed to dwell at a particular location on carpet 12. The detector 45 is preferably comprised of an optical device, such as an optotransistor couple which transmits light between the couple located along a diameter of the exhaust hose 50. Detector 45 is operatively coupled to a red/green light actuator, such as a window comparator 45A which toggles between the red light 54 and green light 52.

As best seen in FIG. 3, the end of housing 40 remote from brush drive motor 20 is supported by an A-shaped bracket 56, which is itself mounted on housing 16.

Referring now to FIGS. 1 and 3, it will be seen that the lower end of exhaust hose 50 terminates at a junction box 60 which is itself affixed to housing 16.

Junction box 60 defines a hollow chamber having an upper opening into which is air-tightly fitted a coupler 62. Coupler 62 serves to air-tightly interconnect the interior of exhaust hose 50 with the interior of junction box 60.

Further, a transition conduit 64 (FIGS. 1 and 6) connects the interior of junction box 60 with the interior of vacuum manifold 66 (FIG. 4).

The end of transition conduit 64 confronting junction box 60 (FIG. 1) is provided with an aperture which has the same configuration and is in registration with an aperture in the face of junction box 60 which confronts transition conduit 64.

A gasket is clamped between transition conduit 64 and junction box 60 so that the interior of junction box 60 is in direct, airflow passing connection with the interior of transition conduit 64, and there is no leakage to ambient atmosphere at this joint.

Referring now to FIG. 6, it will be seen that the interior of transition conduit 64 extends downwardly to vacuum manifold 66, and is in airtight communication with vacuum manifold 66.

It will thus be understood by those having ordinary skill in the art, informed by the present disclosure, that the interior of vacuum manifold 66 is in direct, air-passing communication with the interior of exhaust hose 50, and that the only influx of ambient air into the subsystem comprised of exhaust hose 50, transition conduit 64, junction box 60 and vacuum manifold 66 must be by way of vacuum manifold ports 66.1 and 66.2 (FIG. 4); assuming, as is the case, that the upper end of exhaust hose 50 leads to a vacuum source 70 which is to be described hereinafter in connection with FIG. 2.

Referring now to FIG. 2, there is shown a backpack vacuum source 70 which is commercially available from Miele and Company, GmbH D33332, Gütersloh, Carl-Miele Strasse 29, Germany. In the known manner, backpack vacuum source 70 is provided with a pair of shoulder straps 72.1, 72.2.

As seen in FIG. 1, backpack vacuum source 70 is conveniently worn by operator 14, with straps 72.1 and 72.2 passing over the respective shoulders of operator 14 and snugged by means of takeup devices of well known type which are parts of the commercial version of backup vacuum source 70 identified hereinabove.

It is to be understood, as seen in FIG. 2, that the upper end of exhaust hose 50 is secured in air-tight relationship to the intake port 72 of backpack vacuum source 70.

It is also to be understood that while the exhaust port 74 (FIG. 2) of backpack vacuum source 70 is directly open to ambient atmosphere, the commercially available backpack vacuum source identified hereinabove, which is used as backpack vacuum source 70 in the first preferred embodiment of the present invention, is so effectively filtered that very little of the particulate matter picked up from the carpet being cleaned by drybrush machine 10 is redeposited on the carpet being cleaned. Vacuum 70 provides sequential filters of varying emissivity, with a final filter of ultra low particulate air (ULPA) fineness.

Referring again to FIG. 4, which shows the bottom of drybrush machine 10, it will be seen that a plurality of ribs 80 project outwardly from a support frame 82 which surrounds vacuum manifold 66. Ribs 80 serve to prevent large articles inadvertently not removed from carpet 12 from being picked up by brushes 24, 26.

Referring again to FIG. 6, there is shown a cross-sectional view of the main body portion of drybrush machine 10.

As seen in FIG. 6, drybush machine 10 is disposed upon a horizontal surface bearing a conventional woven broadloom carpet 90, which, in the well known manner, is comprised of a backing 92. Backing 92, in the well known manner, is comprised of a primary backing with which is interwoven yarns to form a pile 94 in the form of a multiplicity of loops.

It is to be particularly noted that, in accordance with the teachings of the present invention, drybrush machine 10 does not include supporting wheels which bear upon carpet 90. To the contrary, drybrush machine 10 is characterized by the fact that it is supported only by brushes 24 and 26.

As also seen in FIG. 6, the housing 16 of drybrush machine 10 is provided with a skirt 16.2.

Skirt 16.2 is formed from suitable semi-rigid material and surrounds the lower edge of housing 16.

Skirt 16.2 is affixed to housing 16 by means of a suitable Velcro® type fastener or fasteners, and thus is vertically positionable and can be located in any desired vertical position, over a predetermined range of positions.

Skirt 16.2 extends substantially completely around housing 16.

In accordance with the present invention, skirt 16.2 is preferably so adjusted that when drybrush machine 10 is standing on a carpet 90 the lower edge of skirt 16.2 slightly penetrates pile 94.

As further seen in FIG. 6, manifold 66 terminates slightly below the plane containing the axes of brushes 24 and 26. More particularly, port 66.1 opens downwardly through the bottom face of manifold 66.

As yet further seen in FIG. 6, transition conduit 64 extends from manifold 66 to junction box 60.

Thus, it will be seen that a vacuum conduit extends from vacuum ports 66.1 and 66.2 (FIG. 4), via transition conduit 64 (FIG. 4), junction box 60 (FIG. 1) and exhaust hose 50 (FIG. 1) to backpack vacuum source 70 (FIG. 1). FIG. 6 also reveals the motor shaft 41 of brush drive motor 20 with the motor rotor and stator structure removed.

Figure 7:
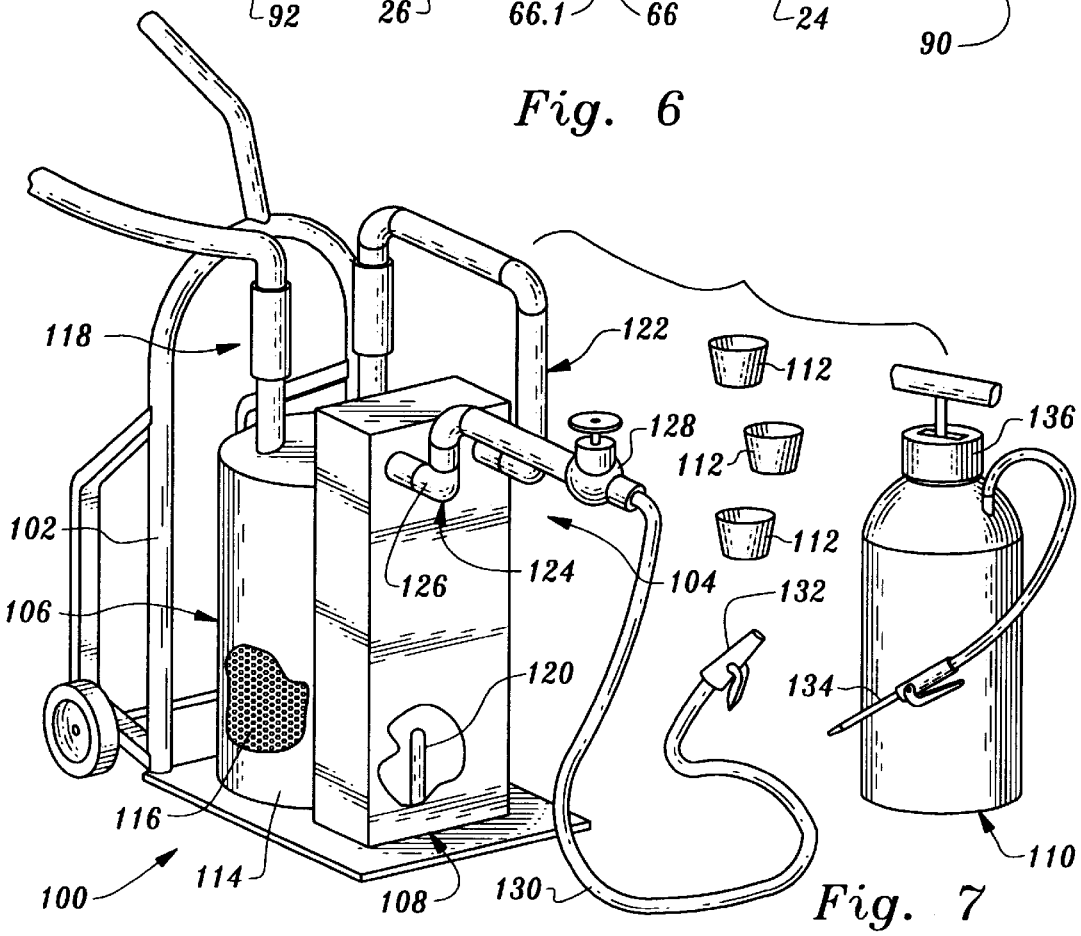
FIG. 7 is a perspective view of the portable water heating and purification unit of the first preferred embodiment of the present invention, including a pump sprayer of the type used to spray the cleaning solution of the present invention over the carpet to be cleaned.

Referring now to FIG. 7, there is shown portable cleaning solution preparation apparatus 100 which is another principal feature of the present invention.

Referring again to FIG. 7, it will be seen that solution preparation apparatus 100 is generally comprised of a cart 102, which bears the portable water treatment and heating apparatus 104 of the first preferred embodiment of the present invention.

The principal units of water treatment and heating apparatus 104 are the water purifier 106 and the water heater 108.

In addition, water treatment and heating apparatus 104 is further comprised of a portable spray tank 110, and a plurality of measuring cups 112.

As seen in FIG. 7, water purifier 106 is comprised of a tank 114 which contains a plurality of ion exchange resin beads 116 of the type made and sold by the Culligan Company. Input water to tank 114 is supplied by input connection 118.

The water flow through tank 114 is purified by a bed of ion exchange resin beads 116, automatically and without the need for additional apparatus, and then flows through connecting conduit 122, from tank 114 to water heater 108.

Water heater 108 contains an electrical heating element 120 whereby the water in heater 108 is thermostatically maintained at a temperature of about 140 degrees Fahrenheit.

The output connection 124 of water heater 108 is comprised of a suitable rigid output pipe or the like 126 to the outer end of which is affixed a valve 128, sometimes called the "primary dispensing valve" herein.

Attached to the output end of primary dispensing valve 128 is a flexible hose or the like 130 to the outer end of which is water-tightly coupled a manually operated valve 132.

Valve 132 is adapted, in the well known manner, to control the flow of heated and treated water from water heater 108 into portable spray device 110.

As will now be evident to those having ordinary skill in the art, informed by the present disclosure, measuring cups 112 contain measured quantities of the active components of the cleaning solution of the first preferred embodiment of the present invention, which, in the manner taught hereinafter, is sprayed on the carpet or other fabric to be cleaned by means of spray tank 110, via wand-type valved nozzle 134. Liquid leaves the nozzle in an outwardly diverging highly atomized fan pattern (FIG. 11) to create a very light mist on only the uppermost portion of the carpet pile.

In the preparation of the cleaning solution of the first preferred embodiment of the present invention cap 136 is removed from tank 110 in the well known manner, and the contents of three of the measuring cups 112 are poured into spray tank 110, whereafter valve 132 is pointed into the opening exposed by the removal of cap 136 and a measured quantity of purified water from water heater 108 is dispensed into spray tank 110.

After replacing cap 136 spray tank 110 is manually agitated, and thus a quantity of cleaning solution is provided in spray tank 110, ready for spraying on the carpet or other fabric to be cleaned via "wand" 134.

Referring now to FIGS. 8, 9, 10 and 10A, there is shown a toweling machine 150 of the first preferred embodiment of the present invention.

Figure 10:
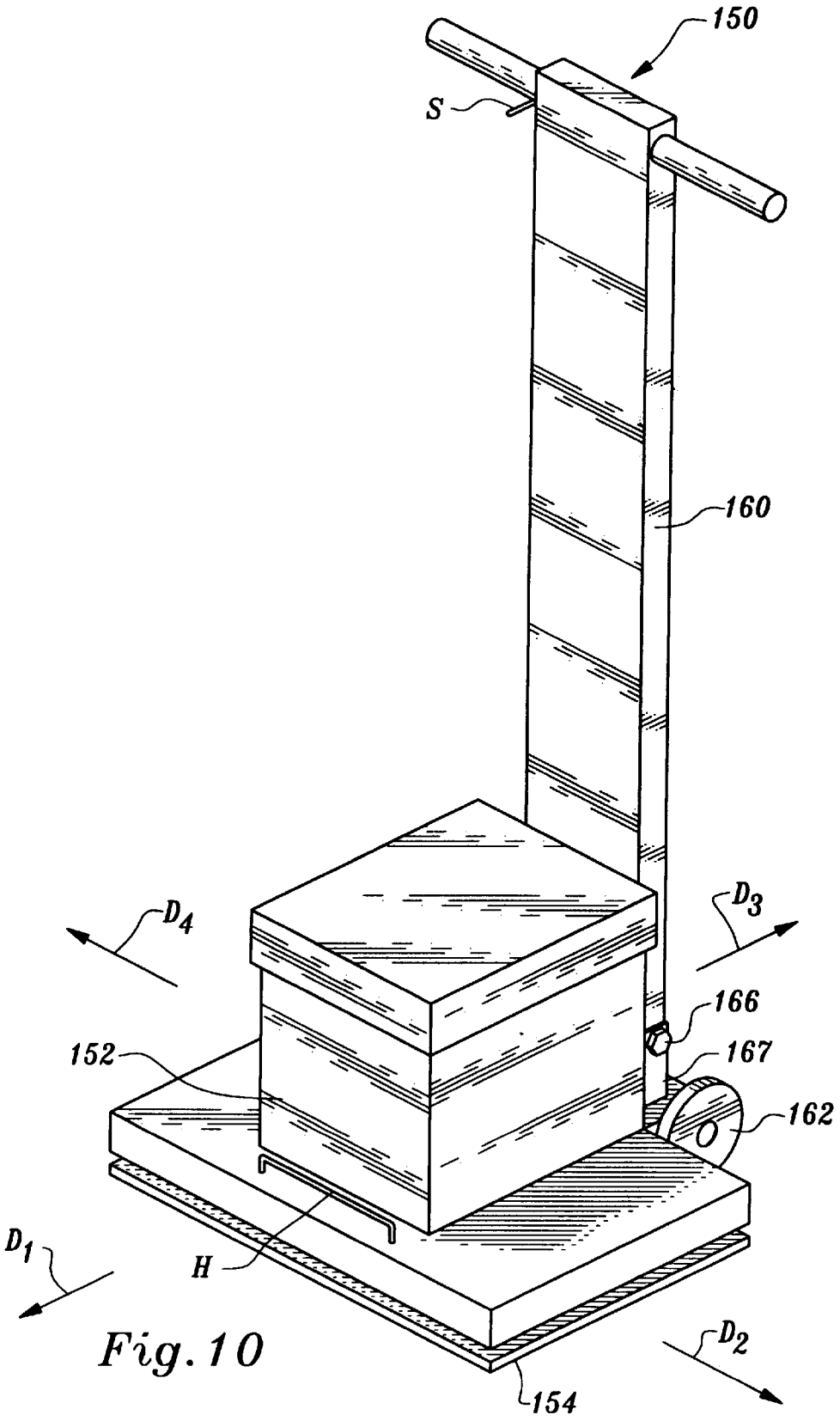
Figure 10A:
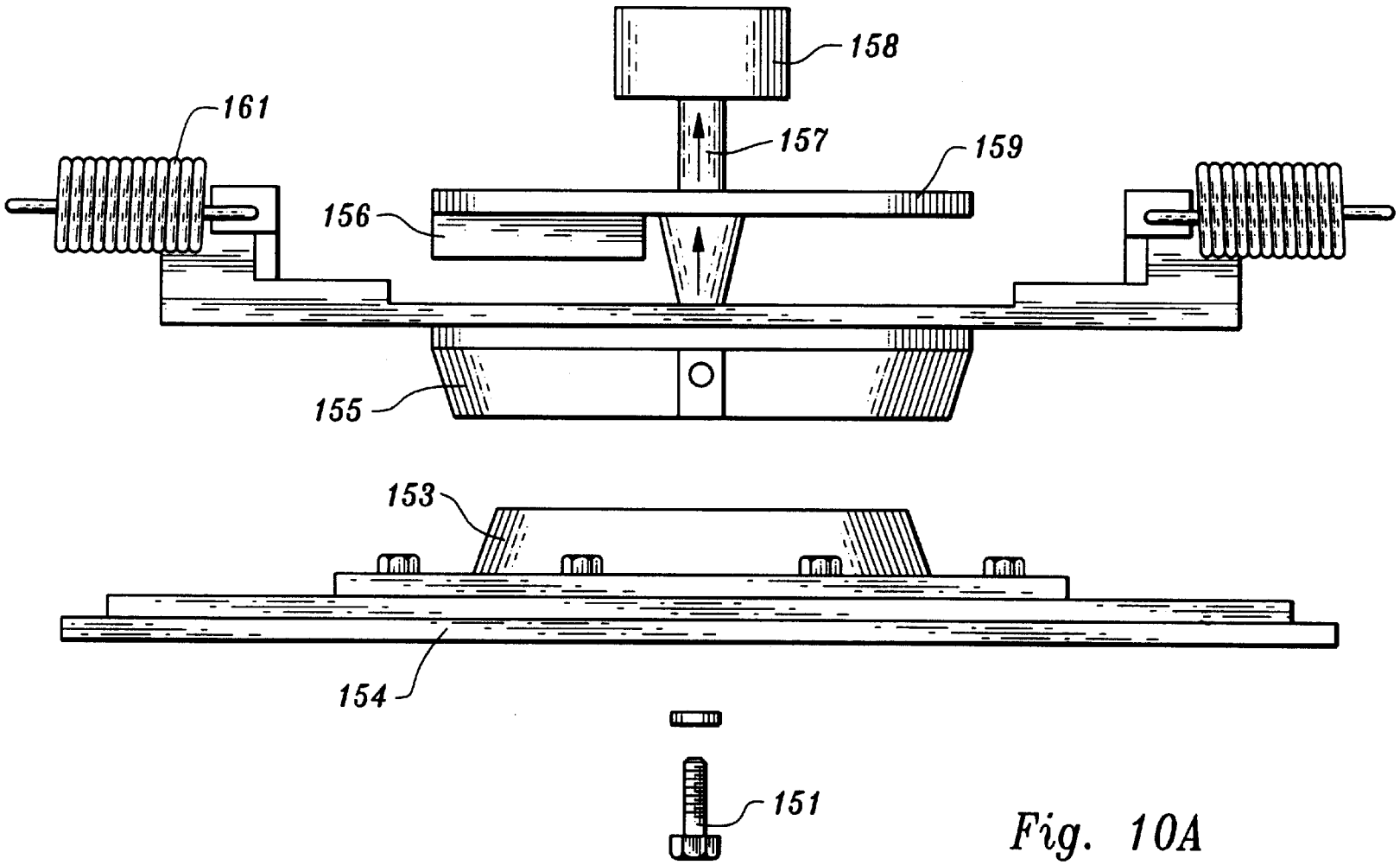
FIG. 10A reveals, in exploded parts, the drive of the toweling machine.

Toweling machine 150 is comprised of a main body member 152 and a sole plate 154. The main body member may be boxed-shaped (e.g., FIG. 10) or cylindrical as suggested in FIG. 8. The body member may include a handle H to assist in loading and unloading during transport. Main body member 152 contains an oscillating mechanism 156 embodied as an off center flywheel attached to motor shaft 157 via flywheel plate 159 (FIG. 10A). Oscillating mechanism 156 serves to oscillate sole plate 154 with respect to main body member 152.

Drive motor 158 is securely affixed to main body 152 and its output shaft 157 is coupled to an orbital oscillating mechanism 156. The shaft 157 couples to plate 154 via a drive disk 155 which is located on shaft 157 and mates with plate assembly 153 which includes the sole plate 154. Plate and disk attach via plate bolt 151 which passes through plate 153, 154 into a disk threaded central bore. Four extremities of disk 155 are constrained to body member 152 via springs 161. This encourages motion of the plate 154 in directions $D_1$, $D_2$, $D_3$, and $D_4$, shown in FIG. 10, rendering very effective toweling.

A handle 160 is pivotably affixed to main body 152, via bracket 167. A pair of wheels 162, 164, are rotatably affixed to bracket 167.

Handle 160 is pivotably mounted on pivot means 166 and conventional locking means are provided whereby handle 160 can be locked in several positions of rotation about pivot means 166. The handle may include an on-off "dead man's" switch S mounted near a hand grip area (FIG. 10).

Figure 8:
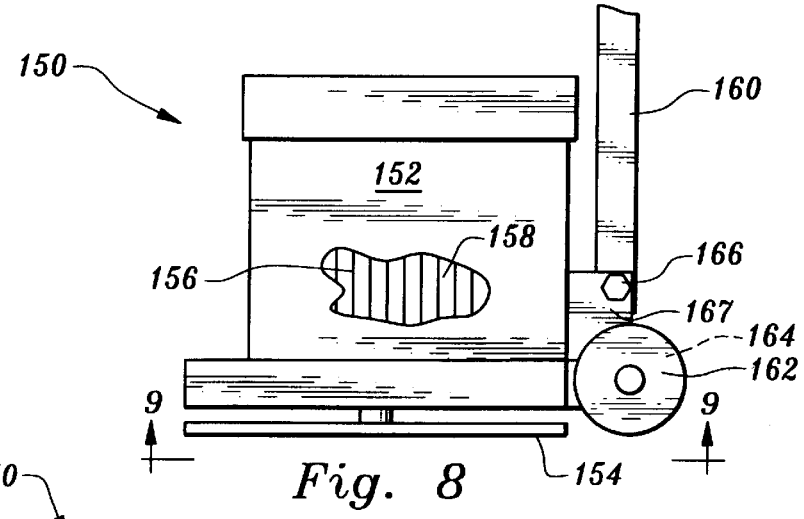
FIGS. 8, 9, 9A and 10 are side, bottom, alternative bottom and perspective views respectively of the toweling machine of the first preferred embodiment of the present invention.

When handle 160 is locked in the position shown in FIG. 8, it may be used to tilt main body 152 and sole plate 154 rearwardly, whereupon toweling machine 150 may be moved from place to place on wheels 162, 164.

When toweling machine 150 is being used to clean a carpet or other fabric, handle 160 is released for selective pivoting between the indicated fixed position shown in solid lines in FIG. 8 and a non-vertical position.

Figure 9:
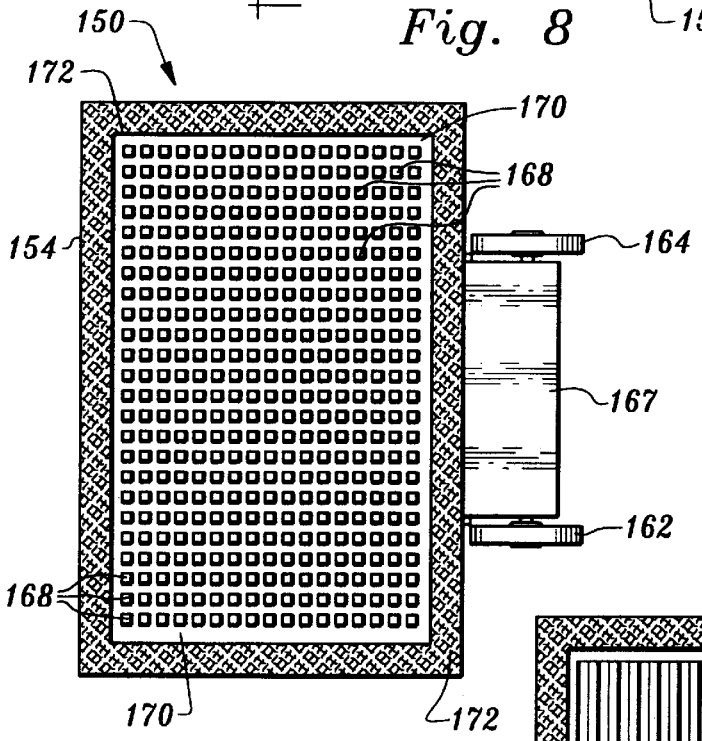

Referring now to FIG. 9, it will be seen that the bottom of sole plate 154 also serves as a back plate 206 (FIGS. 13, 13A, 13B) and is provided with a plurality of rubber bosses 168. Bosses 168 are formed upon a single sheet 170 of the same material as bosses 168, and this sheet is adhered to the lower face of sole plate 154. Bosses 168 can thus be seen to function as a means of maintaining an associated sheet of cloth, such as terrycloth 200 or the like in position with respect to sole plate 154 when sole plate 154 is oscillated over a carpet to be cleaned, between that carpet and sole plate 154.

As further seen in FIG. 9, the outer edge of sole plate 154 is provided with a surround 172, e.g., of hook-type Velcro, by means of which the outer portion of the terrycloth is caused to adhere to the outer portion of sole plate 154. It is to be understood that the Velcro surround 172 is so recessed with respect to the remainder of the bottom face of sole plate 154 that the active outer surface of surround 172 lies in substantially the same plane as the outer faces of bosses 168.

It is to be understood that in accordance with the present invention no further means is provided for securing the terrycloth to bosses 168. By having the cloth towel easily attachable and detachable, a clean cloth towel can be substituted for a soiled one, assuring effective cleaning.

In accordance with the present invention the terrycloth preferably used must be of sufficient weight to resist tearing and burning by the "scraping" action between the carpet and the sole plate. The cleaning solution topically sprayed on the carpet prevents burning by acting as a lubricant and heat diffuser.

Figure 9A:
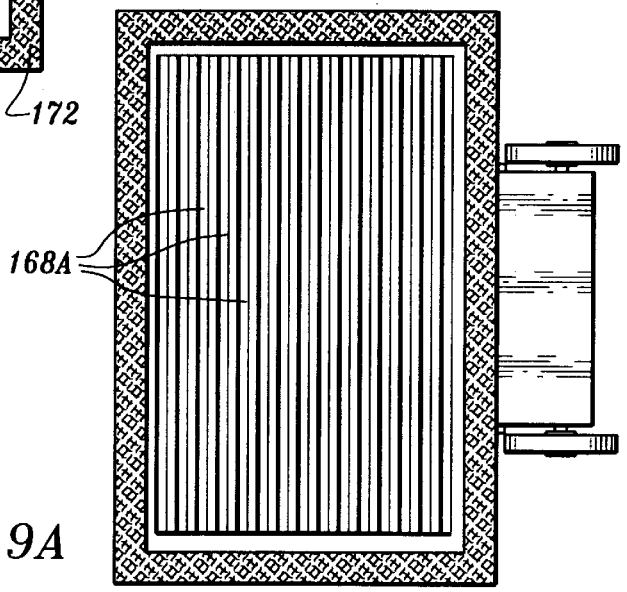

FIG. 9A substitutes the bosses 168 with a series of downwardly projecting, latitudinally extending parallel ridges 168A, i.e., running parallel to the shaft supporting wheels 162, 164. FIGS. 13A, B show alternate ridges 168B, C of a sawtooth configuration. Also the surround 172 is formed from polyproplene or polyethelyne which has been cross-hatched and knurled.

Figure 11:
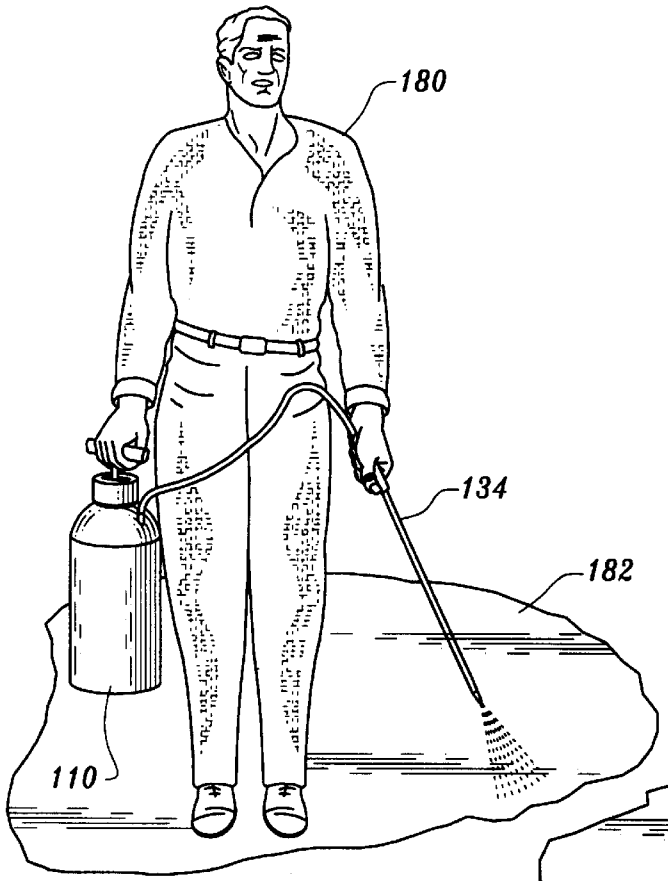
FIG. 11 is a perspective view showing the cleaning solution being sprayed on a carpet to be cleaned in accordance with the first preferred embodiment of the present invention.

Referring now to FIG. 11, there is shown an operator 180 applying a cleaning solution of the present invention to a carpet which is being cleaned in accordance with the principles of the present invention, making use of a spray tank 110 which is described hereinabove in connection with FIG. 7.

In accordance with the present invention, operator 180 attempts to uniformly spray carpet 182 with the cleaning solution of the first preferred embodiment of the present invention by manipulating wand 134 in rapid parallel strokes over the surface of carpet 182, the operator backing up over the carpet so as to avoid tracking of the solution.

In accordance with a principal feature of the present invention, the quantity of solution to be delivered to each unit area of carpet surface is to be minimized, so that after the correct application of the cleaning solution, and a single pass of toweling machine 150, the carpet will be relatively dry to the touch, apparently manifesting to the touch only a hint of moisture.

It has been determined that in this condition only three to six ounces of solution are preferably applied per 100 square feet of carpet. The solution is preferably comprised of "three cups" 112 dry cleaner with one gallon hot, purified water. In actuality the dry cleanser vis-a-vis the water ratio is preferably 1–12 by volume, but can vary 1–8 to 1–15. This minimal amount of cleaner, greatly diluted, abates the cleanser residue problem of the past, combined with dry clean toweling.

Stated alternatively, the toweling step should result in the recapturing of over 90% of the applied solution.

Figure 12:
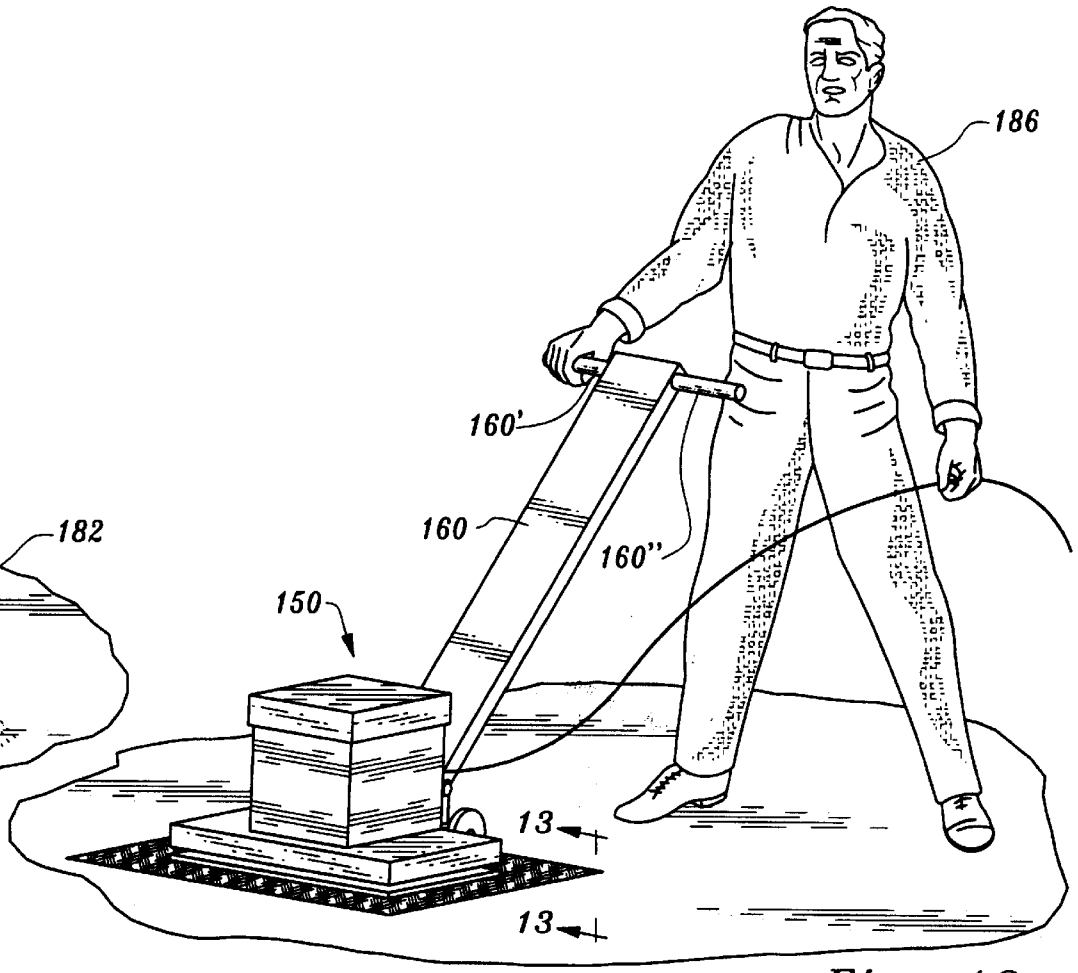
FIG. 12 is a perspective view of the toweling machine of the first preferred embodiment of the present invention being passed over the carpet being cleaned by the operator thereof.

Referring now to FIG. 12, there is shown an operator 186 operating toweling machine 150 of the present invention in accordance with a preferred method of the present invention.

As seen in FIG. 12, operator 186 stands behind toweling machine 150 and pulls the toweling machine 150 toward him or perhaps side to side, over the associated carpet by means of a handle 160, 160', 160". In accordance with a particular feature of the cleaning method of the present invention the toweling machine 150 moves in four directions $D_1$–$D_4$ while traveling it over the associated carpet. The carpet is preferably toweled in different, linear directions.

Figure 13:
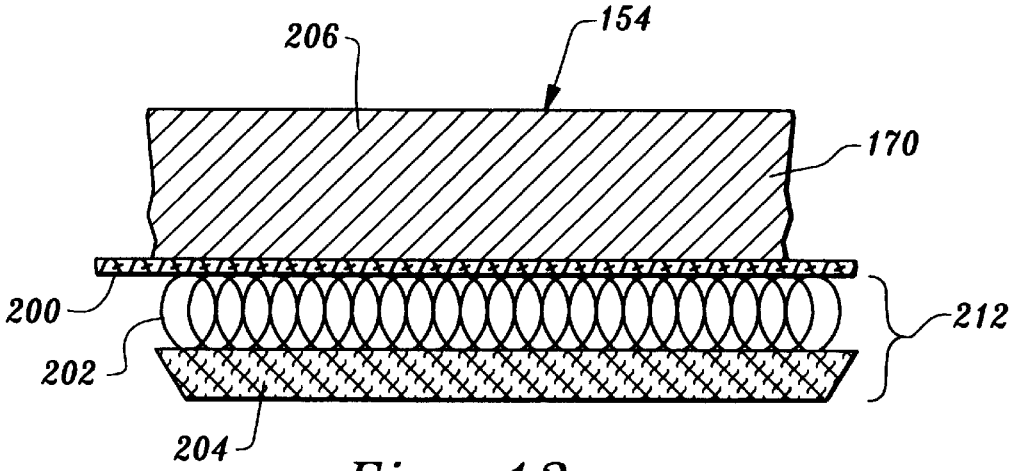
FIGS. 13, 13A and 13B are alternate sectional views of the interface between the toweling machine of the first preferred embodiment of the present invention, a portion of a terrycloth towel, and a portion of the carpet being cleaned. The height of these projections can vary as a function of pile depth.
Figure 13A:
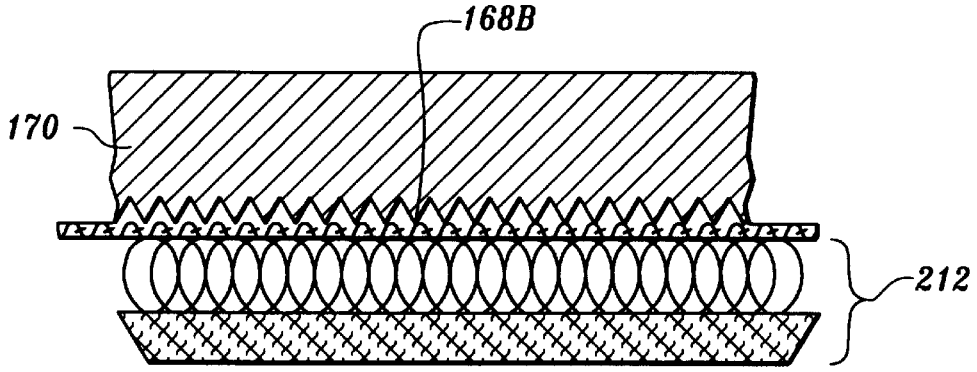
Figure 13B:
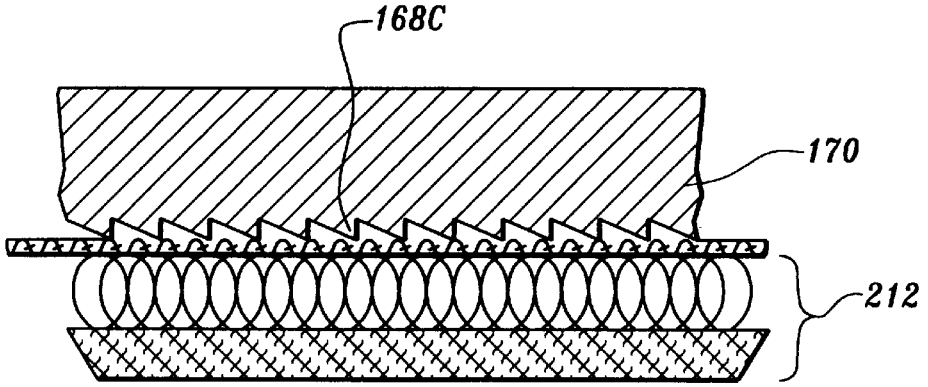

Referring now to FIGS. 13, 13A and 13B the cooperation between sole plate 154, terrycloth 200 and carpet 212 will now be explained in detail.

As seen in FIG. 13, sole plate 154 is comprised of a backplate 206 which is formed from a substantially rigid aluminum member. A rubber sheet 170 is adhered to backplate 206, as by cementing.

A plurality of bosses 168 are raised upon and are integral with rubber sheet 170.

Carpet 212, which is of the woven broadloom type, is comprised of a backing 204. A pile 202 is interwoven with backing 204 in the known manner.

A terrycloth sheet 200 is interposed between carpet 212 and sole plate 154, the bosses 168 of sole plate 154 bearing against the upper face of terrycloth sheet 200.

It is to be understood as part of the present invention that terrycloth 200 is of sufficient weight that the terrycloth has substantial resistance to the vibration of sole plate 154 over the pile of carpet 212.

In addition, terrycloth 200 is preferably of high density, so as to provide a high level of solution absorption, to reduce friction, and burning, and fiber distortion of the carpet.

FIGS. 13A and 13B parallel the FIG. 9 discussion and reflect, two variations of ridges 168A: one 168C swaggered to one direction, and one 168B "neutral", i.e., projecting downwardly.

The preferred embodiment of the toweling machine is originally based upon the 600 Series "Square Buff" floor sanding machine made by the Cordell Engineering Company and S.B.I., Inc., now a division of the Flecto Corporation, Oakland, Calif. However, the machine has been modified extensively to towel carpet.

Figure 14:
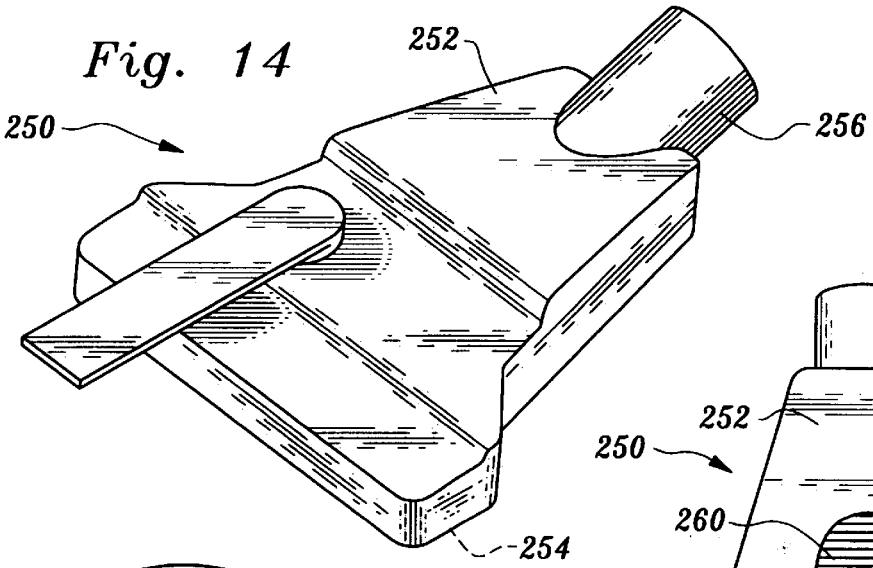
FIGS. 14 and 14A show a hand-held drybrush machine to be used when cleaning a light fabric, (i.e., other than carpeting) by the method, apparatus and system of the first preferred embodiment of the present invention.
Figure 14A:
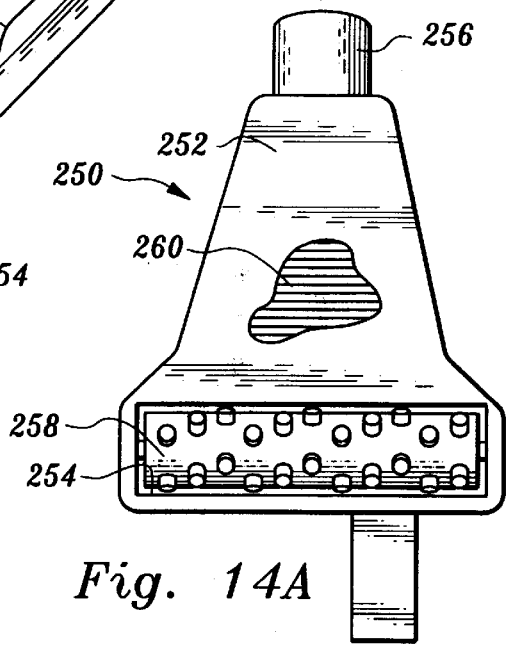

Referring now to FIGS. 14 and 14A, there is shown a small, portable or hand-held dry brush machine 250 of the present invention.

A commercial version of such a dry brushing machine is made by Flecto International Supply, Inc. (SQUAR-BUFF Model 600) 1000-45th Street, Oakland, Calif. 94608 and is shown and described in U.S. Pat. No. 3,416,177 (FIGS. 8–12) and U.S. Pat. No. 4,776,059 (FIGS. 14 and 14A).

Drybrush machine 250 is comprised of a hollow housing 252.

An intake port 254 is located at a first end of housing 252, and an exhaust port 256 is located at the other or second end of housing 252.

Exhaust port 256 is provided in the form of a truncated tube which is adapted to receive one end of an associated vacuum hose, and in particular the hose 50 (FIG. 1) which is coupled to the intake port of backpack vacuum source 70 (FIG. 2). A rotary brush 258 is rotatably mounted just inside intake port 254 (FIG. 14A).

Housing 252 contains an air flow driven turbine 260 which is located adjacent exhaust port 256.

A drive belt couples turbine 260 and rotary brush 258 in such a manner that rotary brush 258 is rotated by, and only by, air passing through housing 252, i.e., is not rotated by a separate electrical drive motor or the like.

Backpack vacuum source 70 can be used as the vacuum source for drybrush machine 250.

It is to be understood that in accordance with the present invention hand-held drybrush machine 250 is used to carry out the dry brushing step of the present invention when draperies, wall coverings, upholstery fabrics, area rugs, scatter rugs, and the like, are being cleaned by means of the method and apparatus of the present invention.

Figure 15:
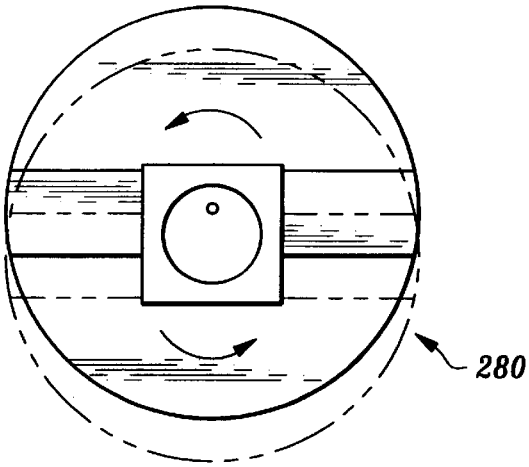
FIGS. 15 and 16 are bottom and perspective views respectively of a hand-held toweling machine of the first preferred embodiment of the present invention to be used when cleaning a light fabric by a method of the present invention.
Figure 16:
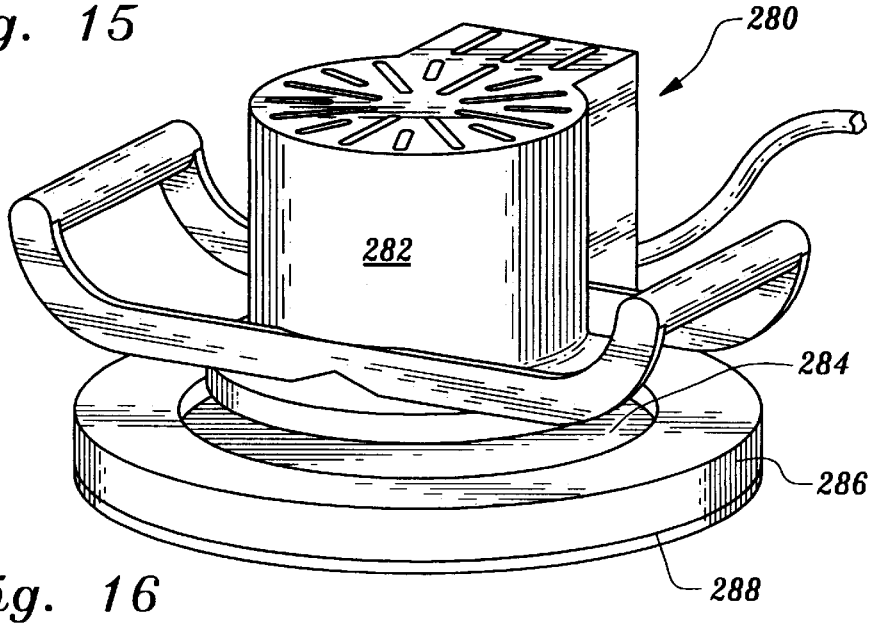

Referring now to FIGS. 15 and 16, there is shown a hand-held toweling machine 280 of the first preferred embodiment of the present invention.

Hand-held toweling machine 280 is commercially available, but heretofore for car polishing purposes. One example is GEM Industries, Inc. of Ft. Lauderdale, Fla., model number ORBIT I-CHD.

FIG. 15 shows the bottom view of hand-held toweling machine 280 with its sole plate removed.

As seen in FIG. 15, an eccentric drive is provided which causes the sole plate to be moved in an orbital path of motion with respect to housing 282 (FIG. 16).

As seen in FIG. 16, sole plate 284 is surrounded by a ring 286 fabricated, e.g., from high density foam plastic material. Attached to the bottom of ring 286 and covering the bottom of sole plate 284 as well, is a disk of woven nylon cloth material 288.

Ring 286 and nylon material disk 288 are joined together as by a suitable adhesive.

Nylon material disk 288 is adhered to the bottom of ring 286 by a suitable cement.

Nylon material 288 is of such a weave that when toweling machine 280 is disposed upon a sheet of terrycloth toweling which is itself disposed upon a surface to be cleaned, then the terrycloth and the material of disk 288 mutually adhere, and thus the terrycloth is orbitally moved over the surface to be cleaned when the drive motor of toweling machine 280 is energized.

The Process of the Invention

Figure 17:
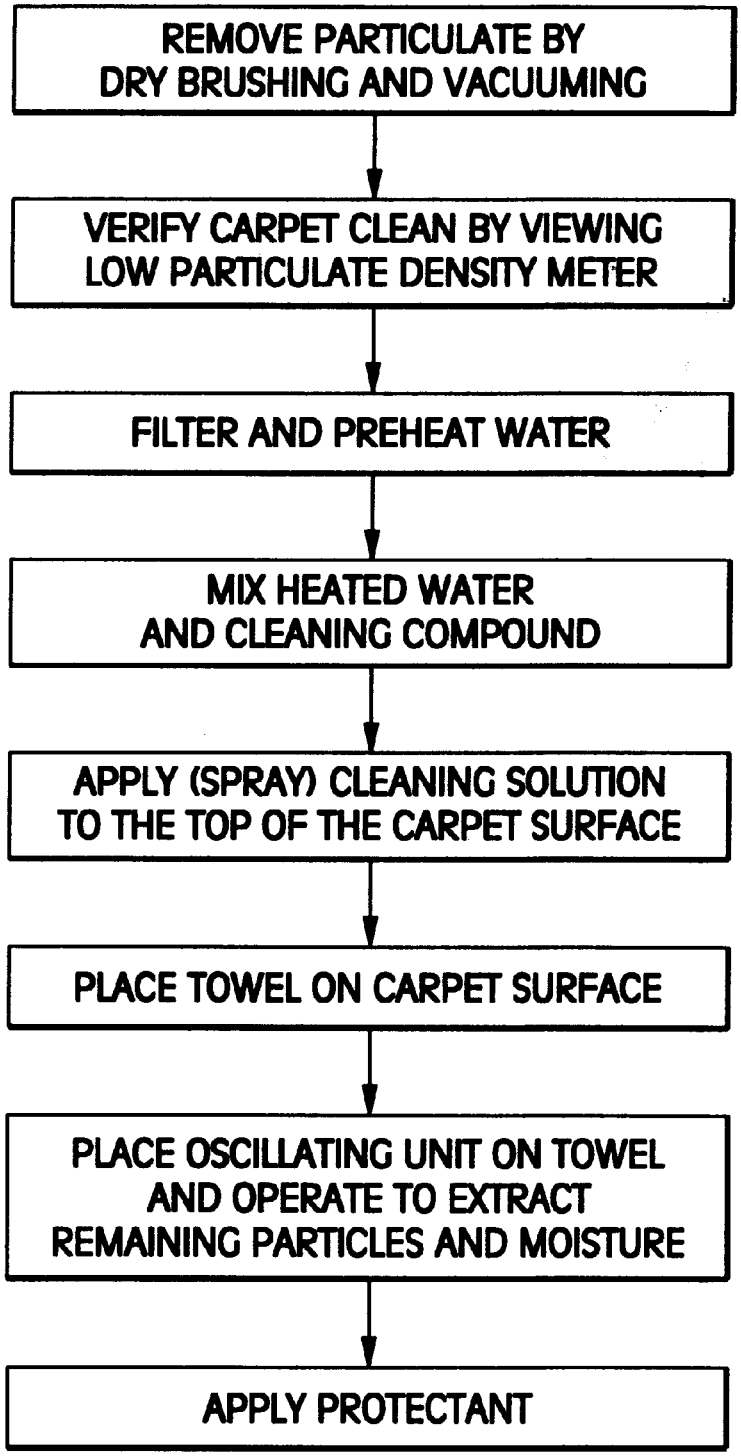
FIG. 17 is a graphic representation of the steps of the method of carpet cleaning of the preferred embodiment of the present invention.

Referring now to FIG. 17 there is shown a flow chart which schematically represents the fabric cleaning processes which are a principal feature of the present invention.

As seen in FIG. 17, the fabric cleaning process of the first preferred embodiment of the present invention is comprised of plural steps, each of which steps is represented by a rectangular box.

The chronological order of these steps is represented serially.

Thus, one step may be seen to be the step of placing toweling on the surface of the carpet being cleaned.

Referring now to the "box" representing step 1 in FIG. 17 it will be seen that step 1 consists principally in drybrushing and vacuuming the carpet (or other fabric) to be cleaned, and thus removing a major part of the particulate matter from the carpet to be cleaned.

It is to be understood that the term "particulate matter" is used herein in its usual acceptation in the trade to mean what lay persons would call the "dirt" in the carpet, including dust, dead skin cells, dust mite feces, particles of human hair, dried soil, particles of food stuffs, etc. In other words, the term "particulate" or "particulate matter" as used herein denotes anything found in a carpet which can be removed mechanically without the use of water or other solvents or fluid systems.

It is to be understood that a principal feature of the present invention is the degree to which it removes microorganisms from the carpet or other fabric being cleaned.

The term "degree" as used herein refers to data which are objectively and scientifically instrumentally measured by the particle detector 45 and not data which results from mere subjective judgment.

It is yet another principal feature of the processes of the present invention that they do not encourage the growth of microorganisms in the carpet being cleaned, either during the cleaning process or afterward. Inter alia, this is due to low moisture application, effective cleaning and removal of residual cleanser.

The dry brushing and vacuuming of this step is preferably carried out by means of a drybrush and vacuuming machine of the type shown in FIGS. 1 through 6 of the present drawings.

It is to be particularly understood that in the carrying out of this step no moisture, or fluid matter, is applied to the carpet to be cleaned.

In the first preferred embodiment step 1 is carried out by an operator 14 (FIG. 1) who circulates the drybrush machine 10 (FIG. 1) over the carpet to be cleaned. The operator passes drybrush machine 10 over successive small sections of the carpet to be cleaned, in a cross-hatching pattern on each such small section.

During the processing of each such small section the operator watches red and green lights 52, 54 (FIG. 5), and does not go on to the next small section until the green light of particle density sensor 45 is illuminated.

As best seen in FIG. 6, both of the brushes 24, 26 are driven deeply into pile 94 by the weight of drybrush machine 10.

Thus, by the particular construction of drybrush machine 10 of the invention, pile 94 is maximally agitated, resulting in the release of a maximum amount of particulate matter during each passage of drybrush machine 10 over the carpet to be cleaned.

While the term "the carpet to be cleaned" is employed in the previous sentence, it is to be understood that the method and apparatus of the present invention are not limited to carpet cleaning, but rather can also be utilized in cleaning upholstery, throw rugs, etc.

Referring again to FIG. 17, it will be seen that step 2 is the monitoring by operator 14 of particulate density sensor 45, in the manner described hereinabove, thus assuring that the amount of particulate matter removed from each small section of the carpet being cleaned is determined instrumentally, and not by subjective operator judgment.

Referring again to FIG. 17, it will be seen that step 3 consists of filtering and preheating water which is to be used as the vehicle of the cleaning solution of the present invention. In accordance with the present invention, step 3 can be efficiently carried out by the use of equipment of the type shown in FIG. 7 and described hereinabove in connection therewith. It is to be noted that in this equipment (FIG. 7) the filtration is not merely mechanical filtration, such as is produced by a sand filtration bed or the like, but rather that in accordance with the present invention ion exchange resin filtration is employed. It has been found that the processes of the invention can be optimized by resorting to such powerful filtration means to sufficiently purify the water which is to be the vehicle of the cleaning solution of the present invention.

Referring to FIG. 17, it will be seen that step 4 of the process of the present invention consists in admixing cleaning compounds with the filtered and preheated water which is produced during step 3.

Referring again to FIG. 17, it will be seen that the next step consists of spraying a minuscule amount of the cleaning solution of the present invention on the top pile portion of the carpet to be cleaned, as taught hereinabove in connection with FIG. 11.

Referring against to FIG. 17, it will be seen that the step 6 consists of placing on the surface of the carpet to be cleaned a sheet of terrycloth, such as sheet 200 shown in FIG. 13 and described hereinabove in connection therewith.

Referring to FIG. 17, it will be seen that the step 7 consists of placing a toweling machine such as toweling machine 150 shown in FIGS. 8, 9, 10 and 12 on the terrycloth sheet placed on the carpet to be cleaned in the previous step, and then operating said toweling machine over the surface of the carpet to be cleaned as described hereinabove in connection with FIG. 12.

In executing step 7 it may be found desirable by the operator, depending upon the appearance of the terrycloth sheet, to repeat steps 5 through 7, using minuscule amounts of cleaning solution. In the case of heavily-soiled carpets it may be found desirable to repeat this supplementary step up to nine times. The cleaning solution not only releases dirt, but also lubricates and minimizes friction between the towel, toweling machine and carpet.

Finally, a protectant can be applied. The protectant can be sprayed as shown in FIG. 11 with a known water or petro-solvent based protectant. Alternatively, the protectant can be placed on a clean towel and "toweled" into the carpet as per FIG. 12.

Moreover, having thus described the invention, it should be apparent that numerous structural modifications and adaptations may be resorted to without departing from the scope and fair meaning of the instant invention as set forth hereinabove and as described hereinbelow by the claims.

What is claimed is:

1. A method for separating contamination from fibrous material; including the steps of:

concurrently dry brushing and vacuuming the fibrous material upwardly, thereby removing some of the contamination;

spraying the fibrous material on its uppermost surface only with a cleaning fluid, such that some more of the contamination is released from the fibrous material and into the fluid; and toweling the fluid onto a dry absorbent surface from the fibrous material by adhering a clean, dry towel onto an underside of a machine, thereby drying the fibrous material and periodically replacing the towel when wet and dirty.

2. The method of claim 1 wherein the removing includes dry brushing and vacuuming of the fibrous material while dry in order to initially remove a large percentage of the contamination embodied as particulate matter from the fibrous material to be cleaned before any steps take place which involve the cleaning fluid.

3. The method of claim 2 further including continuously sensing particulate matter density during vacuuming and displaying the density of the particulate matter being vacuumed from the fibrous material during vacuuming to signal comparative cleanliness.

4. The method of claim 3 further including heating and, purifying the water and mixing the thus purified water with a cleaning compound to form the cleaning fluid.

5. The method of claim 4 further including spraying the cleaning fluid onto a selected area of the fibrous material to be cleaned while the fluid is still heated and allowing the cleaning fluid to remain onto said selected area of the fibrous material throughout a predetermined time interval.

6. The method of claim 5 further including toweling the fibrous material by adhering a clean, dry towel onto an underside of an oscillating machine, drying the fibrous material and periodically replacing the towel when wet and dirty.

7. The method of claim 6 further including agitating the fibrous material in four orthogonally different directions during toweling whereby the particulate matter is absorbed from the fibrous material, transferring moisture into the towel.

8. The method of claim 7 further including applying protectant to the fibrous material which has been cleaned by spraying protectant upon the cleaned fibrous material.

9. The method of claim 8 further including adjusting depths of the dry brushing and the fibrous material is a carpet.

10. A method for carpet cleaning, including the steps of:

filtering water to remove impurities;

heating the water;

adding a cleaning compound to the water to form a cleaning solution;

concurrently dry brushing and vacuuming the carpet;

spraying the cleaning solution onto the carpet;

placing a dry, clean terry cloth towel on a toweling machine and on the carpet; and rubbing the towel on the carpet to remove the cleaning solution.

11. The method of claim 10 wherein the cleaning compound is initially in dry form and the adding step includes adding the dry cleaning compound to the water in the ratio range from 1–8 to 1–15, by volume.

12. The method of claim 11 including purifying the water by treating the water with ion exchange resin beads.

13. The method of claim 12 including heating and maintaining the water at a temperature of about 140° F.

14. The method of claim 13 including spraying the cleaning solution as a highly atomized light mist, in a fan pattern and only on the uppermost portion of pile of the carpet.

15. The method of claim 14 including spraying the cleaning solution in a series of rapid, parallel strokes and avoiding tracking by backing up over the carpet while spraying.

16. The method of claim 15 including spraying 3–6 oz. of the cleaning solution over 100 square feet of carpet.

17. The method of claim 16 including removing over 90% of the cleaning solution with the towel.

18. The method of claim 17 including rubbing the towel in an oscillatory motion.

19. The method of claim 18 including a final step of applying protectant to the carpet.

* * * * *